US006725494B2

(12) United States Patent
Cann

(10) Patent No.: US 6,725,494 B2
(45) Date of Patent: Apr. 27, 2004

(54) BUTTERFLY SPONGE MOP

(75) Inventor: Robert A. Cann, Amherst, MA (US)

(73) Assignee: Milla Company, Inc., Amherst, CA (US)

( * ) Notice: Subject to any disclaimer, the term of this patent is extended or adjusted under 35 U.S.C. 154(b) by 108 days.

(21) Appl. No.: 10/042,956

(22) Filed: Jan. 9, 2002

(65) Prior Publication Data

US 2002/0124339 A1 Sep. 12, 2002

Related U.S. Application Data

(60) Provisional application No. 60/260,527, filed on Jan. 10, 2001.

(51) Int. Cl.[7] ..... A47L 13/146
(52) U.S. Cl. ..... 15/119.2
(58) Field of Search ..... 15/116.2, 119.2; D32/44

(56) References Cited

U.S. PATENT DOCUMENTS

| | | | | | |
|---|---|---|---|---|---|
| 2,643,407 A | | 6/1953 | Vosbikian et al. | ..... | 15/119.2 |
| 2,834,035 A | | 5/1958 | Vosbikian | ..... | 15/119.2 |
| 2,877,478 A | * | 3/1959 | Kohlwey et al. | ..... | 15/119.2 |
| 3,483,583 A | * | 12/1969 | Baumgartner | ..... | 15/119.2 |
| 4,044,419 A | | 8/1977 | Robinson | ..... | 15/119.2 |
| 5,502,858 A | * | 4/1996 | Hoagland et al. | ..... | 15/119.2 |

FOREIGN PATENT DOCUMENTS

| | | | | |
|---|---|---|---|---|
| FR | 1366287 | * | 6/1964 | ..... 15/116.2 |
| FR | 1427042 | * | 12/1965 | ..... 15/119.2 |
| GB | 967566 | * | 8/1964 | ..... 15/116.2 |

* cited by examiner

*Primary Examiner*—Mark Spisich

(57) ABSTRACT

A butterfly type sponge mop includes a self-contained wringing mechanism comprising only two molded parts, an actuating lever and an enclosed yoke. A pair of hinged wings can be integrally molded onto one end of the actuating lever, and the lever can rotate back and forth within the enclosed yoke. Guides within the yoke can swing the wings closed when the lever is moved forward, squeezing a detachable sponge. The mechanical advantage of the actuating lever can increase as it is moved forward. Moving the lever back to its original position can cause the wings to swing back open, aided by the compression of the sponge.

4 Claims, 7 Drawing Sheets

BUTTERFLY SPONGE MOP

This application claims benefit of Provisional patent application No. 60/260,527, filed Jan. 10, 2001.

FIELD OF THE INVENTION

This invention relates to sponge mops, and more particularly to a type known as a butterfly mop wherein a self-wringing mechanism transversely folds and squeezes together two wing-like halves holding a detachable sponge.

BACKGROUND OF THE INVENTION

Self-wringing sponge mops are well known, and many prior art designs exist. Generally a long tubular handle and a detachable sponge or sponge-like material are affixed to more or less opposite ends of a mop head assembly that includes a self-wringing mechanism. As is known, the long tubular handle extends the user's reach, the detachable sponge allows for sponge replacement when needed, and the self-wringing mop head mechanism provides a useful and convenient means to quickly and repeatedly expel dirt and liquid from the sponge.

Butterfly type self-wringing mechanisms for sponge mops are also well know, wherein the detachable sponge is mounted on parallel wing-like halves that hinge transversely toward each other along axes more or less aligned with the mop handle. To squeeze the sponge various sliding or rotating mechanisms are known, or combinations thereof. Many show a pivoting yoke or lever that rotates around an axis positioned longitudinally above the sponge (and therefore perpendicular to the wing axes) that is moved back and forth past the wings to alternately squeeze and release them, thus expelling dirt and liquid from the sponge. Rollers may be mounted on the yoke to reduce sliding friction, and return springs may be attached to the hinged wings to assist their movement. Additionally, a movable handle mounted grip or lever may be attached to the yoke via a linkage, thus allowing the wringing mechanism to be actuated remotely. This helps prevent the user's hands from becoming soiled by a wet and dirty sponge.

Despite the manufacturing cost and assembly complexity posed by the use of such elaborate wringing mechanisms as those enumerated above, butterfly mops have nevertheless proven successful over many years by dint of their compact size, efficient functionality, and ease of operation. More recently, the use of molded thermoplastic resin construction has helped reduce the cost and complexity of butterfly mops. For example, it is known that separate fasteners (e.g., screws and rivets) can be eliminated by integrating their function into molded parts. It is also known that resin parts need not be plated or painted to resist rust, unlike sheet steel components traditionally used. It is also known that separate butterfly wings formerly attached with hinge pins can be molded as integral parts of the mop head by interconnecting them with thin flexible webs known as living hinges. And it is also known that friction reducing rollers can be eliminated because certain molding resin have low friction coefficients (e.g., they slide easily against other surfaces).

DESCRIPTION OF PRIOR ART

U.S. Pat. No. 2,643,407 (Vosbikian) discloses a sponge mop with an early butterfly style wringing mechanism. The wringing mechanism requires at least eight separate parts, namely, a central body, two hinged wings, two hinge pins, a pivoting extractor lever, and two cone shaped rollers to reduce friction. In fact this invention is currently manufactured and sold as the Quickie Automatic Sponge Mop, but with at least five additional parts, namely, two wing return springs, a movable remote grip, a linkage connecting the extractor lever to the remote grip, and a rivet connecting the remote grip to the linkage. Thus, the wringing mechanism of this mop requires a total of at least thirteen individual parts.

In summary, the Vosbikian patent, as exemplified by the Quickie Automatic Sponge Mop, teaches a useful butterfly sponge mop design but requires many separate parts that increase its manufacturing cost and assembly complexity.

U.S. Pat. No. 4,044,419 (Robinson) discloses a sponge mop with an improved butterfly style wringing mechanism, wherein Quickie's thirteen part construction described above has been reduces to just three, namely, a one piece central body with integrated wings, a one piece actuator lever with integrated grip, and a single return spring. First, Quickie's five-piece wing assembly (central body, two wings, and two hinge pins) has been reduced to just one part, namely a central body with integrated wings. Injection molded thermoplastic resin construction allows the wings to integrally connect to the central body using thin flexible webs known as living hinges, thus eliminate the need for separate wings and hinge pins. Second, Quickie's six-piece lever and grip assembly (lever, two rollers, grip, linkage, and rivet) has been reduced to a single part. The use of injection molded resin construction allows the elimination of separate rollers to reduce friction, and also allows the grip to be integrated into the lever. Relocation of the grip and lever to the upper side of the mop head moves the user's hands away from the wet and dirty sponge, thus reducing the need for a remote grip, linkage, and rivet. Third, Quickie's pair of wing return springs is replaced by a single spring passing across the central body to connect one wing to the other.

Certain problems are apparent on closer examination of the Robinson patent. First, it claims a mop head of two basic parts, but in fact it shows a third part, a wing return spring, that is required to return the wings to their in-line planar position. Extra parts add cost and complicate assembly. Second, the parallel actuator members that squeeze the sponge are generally unsupported or interconnected near where they squeeze the central portion of the sponge, and thus may deflect or twist outward and provide a less satisfactory wringing action, particularly with denser and less compressible sponge materials. Third, both molded parts require expensive die side actions to be molded as shown in the patent. The stiffening ribs around and across the outsides of the parallel members of the actuator cannot be molded except with large outwardly movable die side actions with elaborate matched parting lines. And at least one or more of the features described on the mop head (handle socket, actuator socket, or spring locating pins) will also require expensive die side actions.

In summary, the Robinson patent teaches useful improvements over the Vosbikian patent, but further improvements are possible, particularly with regard to making the molded parts less costly through more efficient geometry and fewer required die side actions.

SUMMARY OF THE INVENTION

The butterfly sponge mop according to my invention includes a pair of hinged wings integrally molded onto one end of an actuating lever. This lever pivots forward and back within an enclosed yoke. Moving the lever forward causes the wings to swing closed, thus squeezing a detachable sponge. Moving the lever back to its original position causes the wings to swing open, aided by the compression of the sponge. The wings are positively held in their open position by wing tabs that move in and out of corresponding pockets within the yoke as the actuating lever is moved forward and back. The lever continuously changes its mechanical force on the wings, such that initial forward movement closes the wings rapidly, while further forward movement produces a decreasing movement of the wings.

It is an object of my invention to provide a butterfly sponge mop that requires only two parts for the entire wringing mechanism, this being an improvement over the three part Robinson patent described above (e.g., two basic parts, plus a return spring). It is another object of my invention to provide a butterfly sponge mop with wing tabs that hold the wings in their open position, thus eliminating the need for wing return springs. It is another object of my invention to provide a butterfly mop wherein the yoke holding the actuating lever is of enclosed design, with unique girder geometry. It is another object of my invention to provide a butterfly mop wherein the yoke holding the actuating lever can be molded in a molding die with no side actions except one, and that one being of small size and simple geometry. It is a further object of my invention to provide a butterfly sponge mop wherein the actuating lever with its integrally molded wings can be molded in a molding die with no side actions whatsoever.

Figure 1:
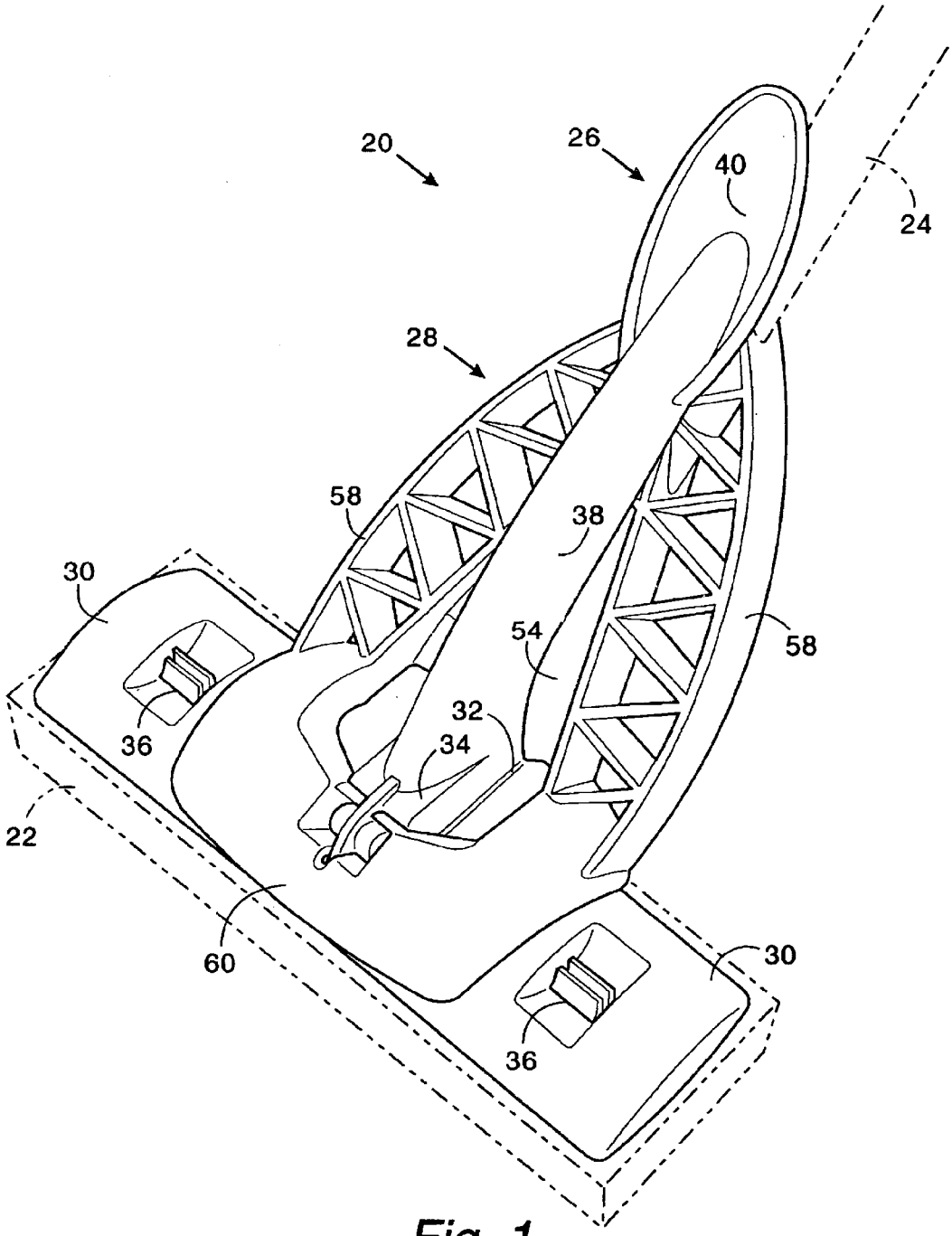
FIG. 1 is a front perspective view of a butterfly sponge mop in the open position.
Figure 2:
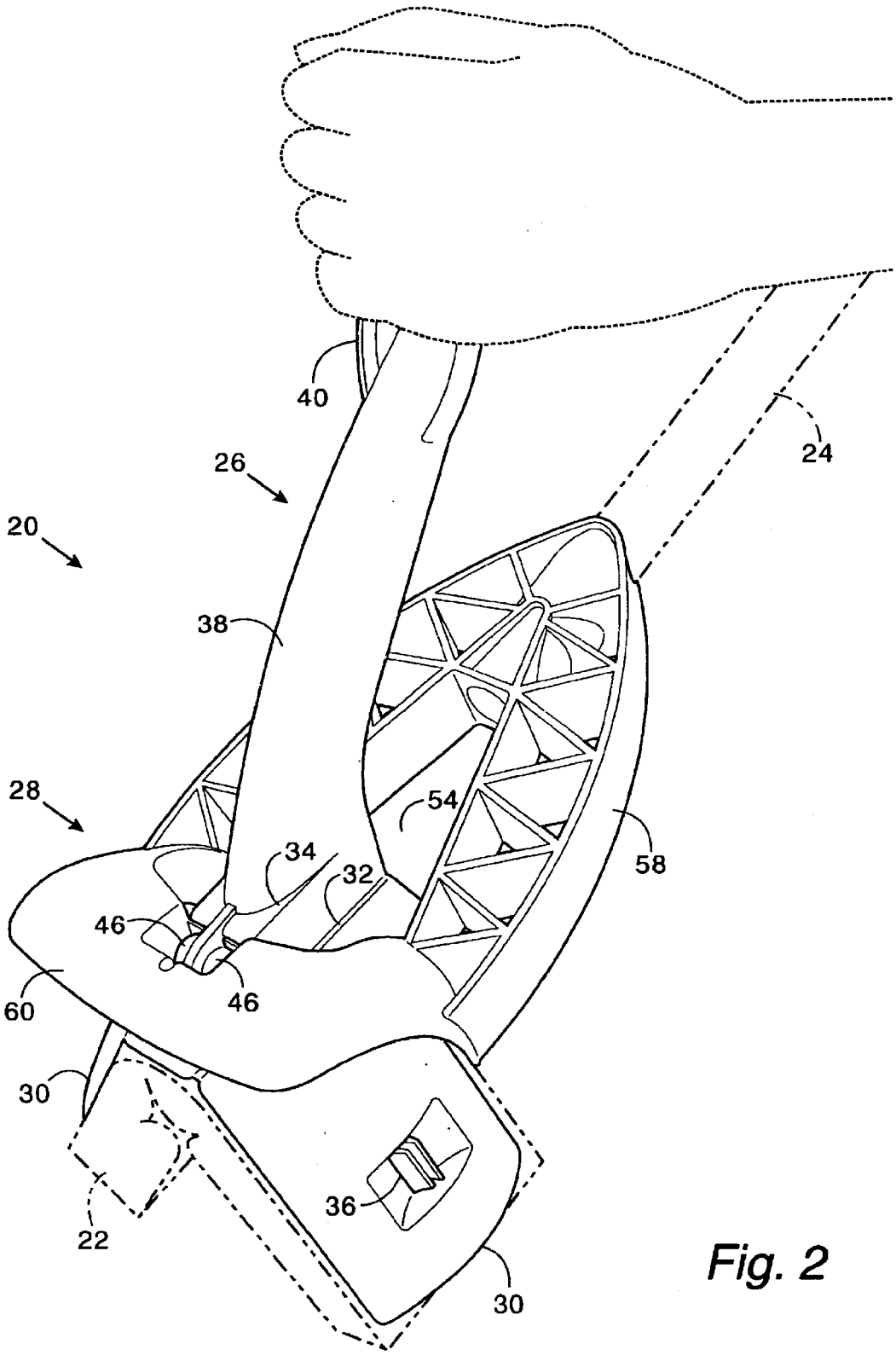
FIG. 2 is a view similar to FIG. 1 showing the sponge partially squeezed or actuated.

| Reference Numerals Used in Drawings | |
|---|---|
| 20 | wringing assembly |
| 22 | detachable sponge |
| 24 | tubular handle |
| 26 | actuating lever |
| 28 | enclosed yoke |
| 30 | wing |
| 32 | living hinge |
| 34 | central body |
| 36 | aperture |
| 38 | extension |
| 40 | grip |
| 42 | tab |
| 44 | trailing edge |
| 46 | boss |
| 48 | wall |
| 50 | void |
| 52 | rib |
| 54 | opening |
| 56 | socket |
| 58 | girder |
| 60 | skirt |
| 62 | support |
| 64 | slot |
| 66 | guide |
| 68 | pocket |
| 72 | edge |
| 74 | bearing point, start |

-continued

| Reference Numerals Used in Drawings | |
|---|---|
| 76 | path |
| 78 | bearing point, end |

DETAILED DESCRIPTION OF THE DRAWINGS

Referring to FIG. 1 through FIG. 7, the butterfly sponge mop according to my invention generally includes a wringing assembly 20, a detachable sponge 22, and a tubular handle 24. The wringing assembly includes an actuating lever 26 and an enclosed yoke 28, both being preferably constructed of a rigid injection molded thermoplastic such as polypropylene.

The actuating lever 26 has wings 30, 30 integrally connecting by living hinges 32, 32 to either side of a central body 34, the hinges being spaced apart so that in the squeezed position they are generally parallel to each other. An aperture 36 to receive the detachable sponge 22 may be positioned more or less centrally on each wing 30. An extension 38 connects a grip 40 to the central body 34. A tab 42 extends from the trailing edge 44 of each wing 30, positioned adjacently above the living hinge 32. A short round boss 46 extends outward from either side of a wall 48 located longitudinally on the central body 34. The axis of the bosses 46, 46 passes transversely across the central body slightly above the hinges 32, 32. A generally C-shaped void 50 around each boss 46 allows them to formed between mating halves of a molding die, rather than by moving side actions in the die. Dies without moving side actions are less expensive to design, fabricate, and maintain. All features of the actuating lever 26 and its integrally molded wings 30, 30 are positioned relative to each and angled in such a manner that it can be molded entirely within a die without moving side actions. Optional stiffening ribs 52 on the rear of the actuating lever 26 and its integral wings 30, 30 allow for more efficient material structure (e.g., thinner, lighter, and less expensive), but their absence has little or no detrimental effect on the function of my invention.

The enclosed yoke 28 has a large central opening 54 for the actuating lever 26. The opening 54 tapers toward a socket 56 at one end that receives the tubular handle 24. The socket 56 is connected on either side via triangulated girders 58 to a curved skirt 60 at the other end. A pair of generally J-shaped supports 62, 62 project rearward from the central portion of the skirt 60 adjacent to the central opening 54, and are separated by a slot 64. Angled guides 66, 66 project inward from either side of the central opening 54, adjacent to where the girders 58, 58 meet the skirt 60. A portion of the guide 66 forms an open and generally V-shaped pocket 68. These pockets 68, 68 hold the wings 30, 30 in their open position by receiving wing tabs 42, 42.

Figure 3:
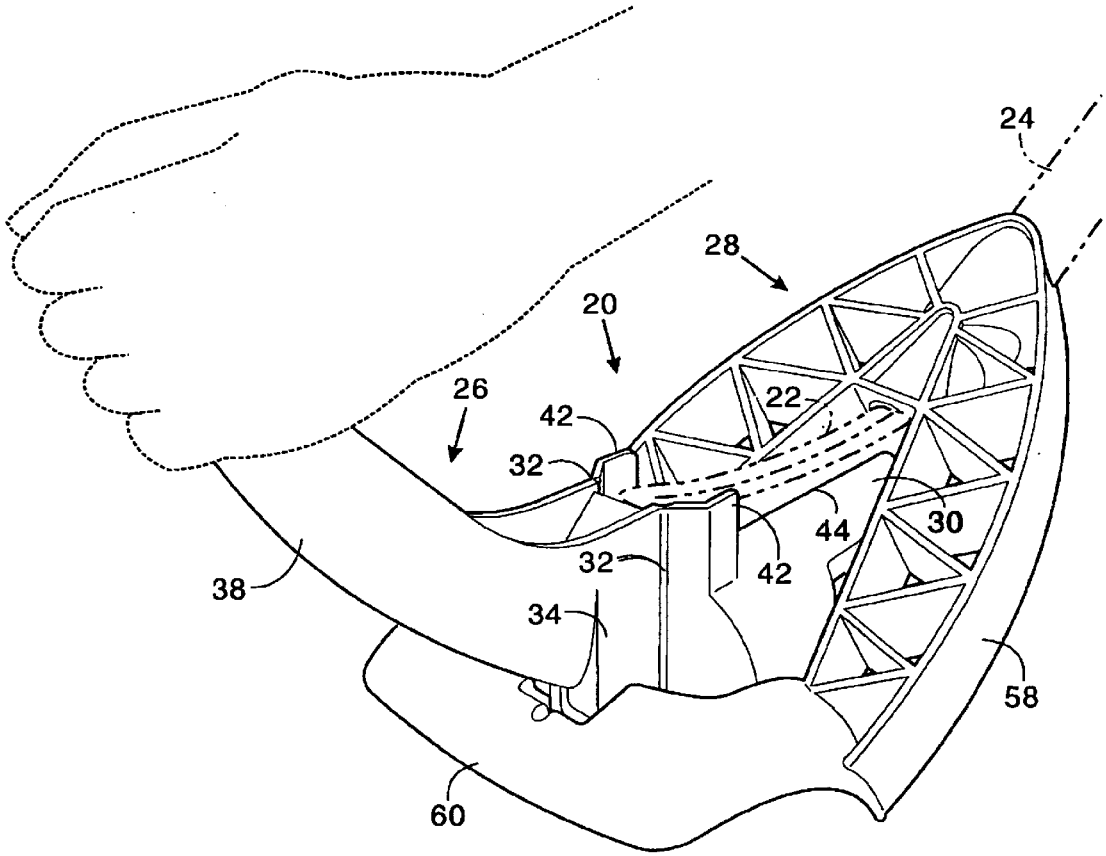
FIG. 3 is a view similar to FIG. 1 showing the sponge fully squeezed or actuated.
Figure 4:
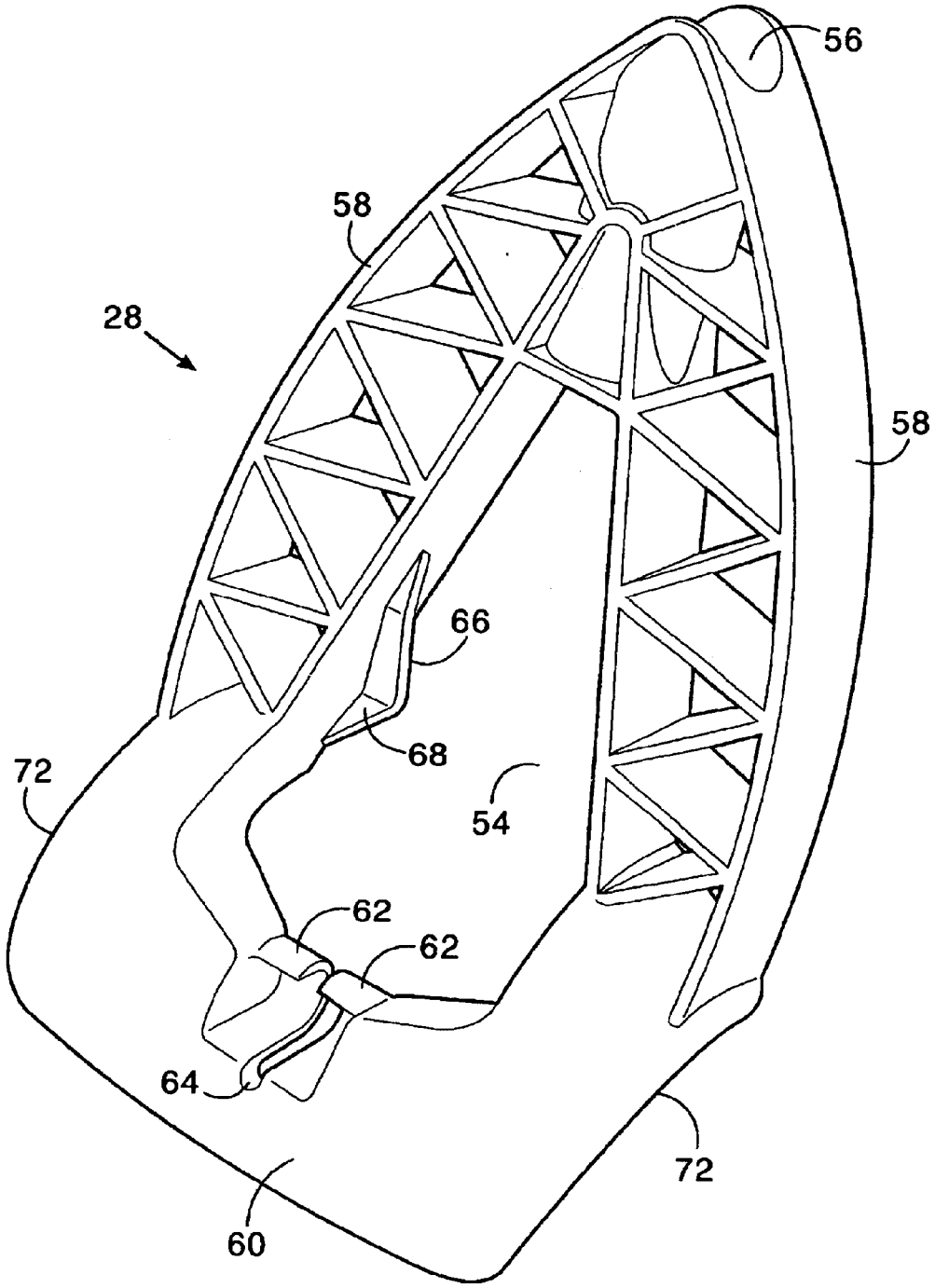
FIG. 4 is a front perspective view of the enclosed yoke.
Figure 5:
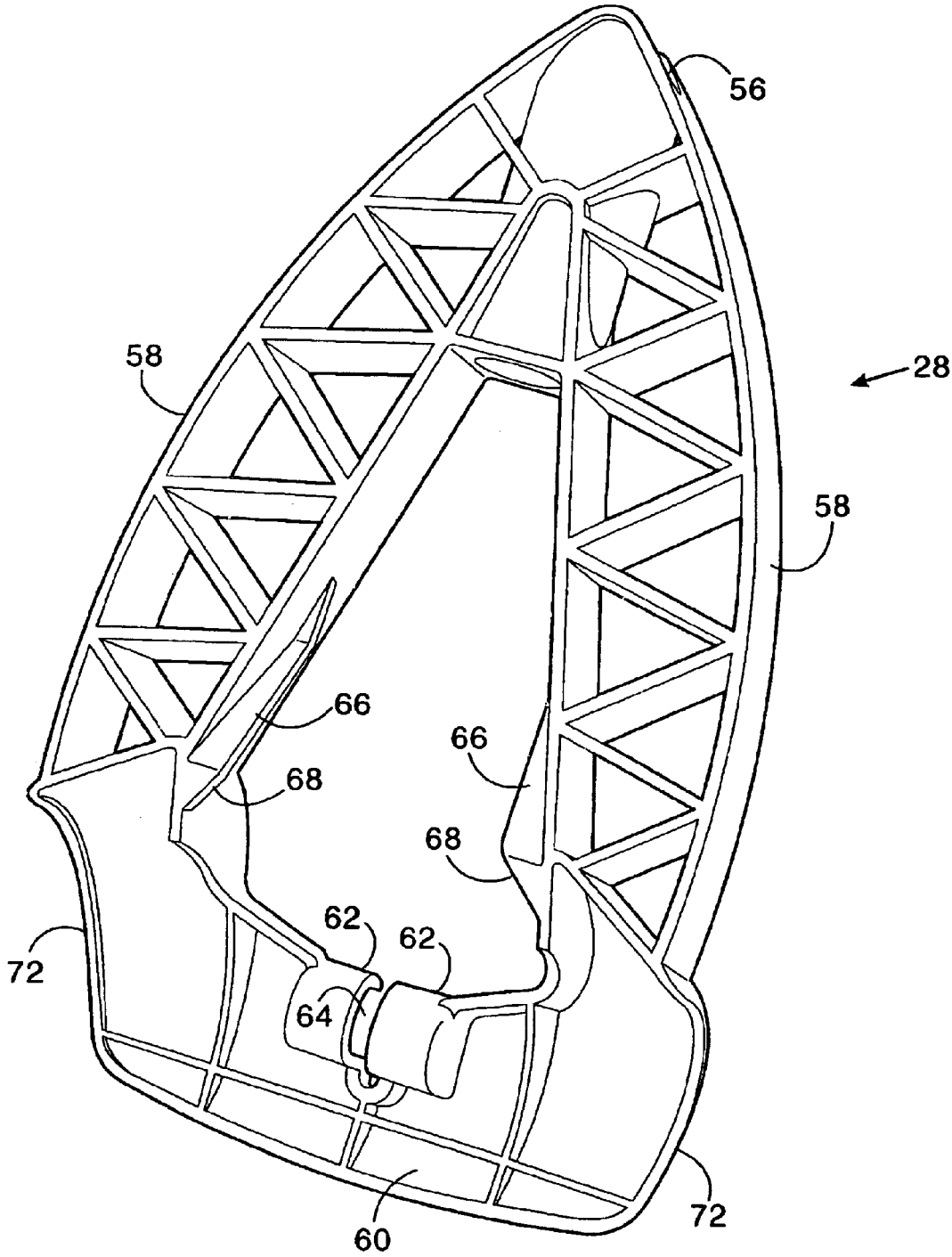
FIG. 5 is a rear perspective view of the enclosed yoke.
Figure 6:
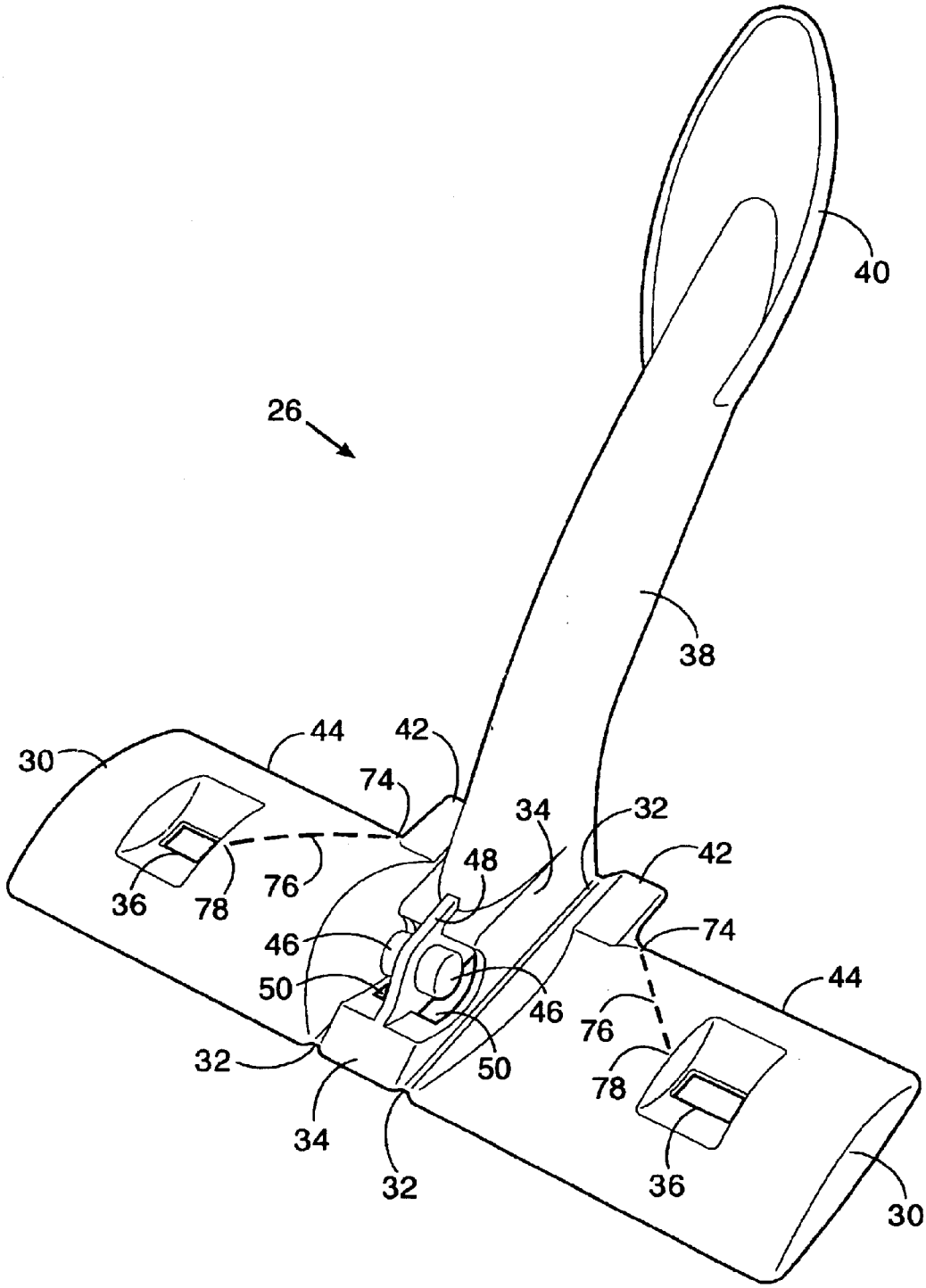
FIG. 6 is a front perspective view of the actuating lever.
Figure 7:
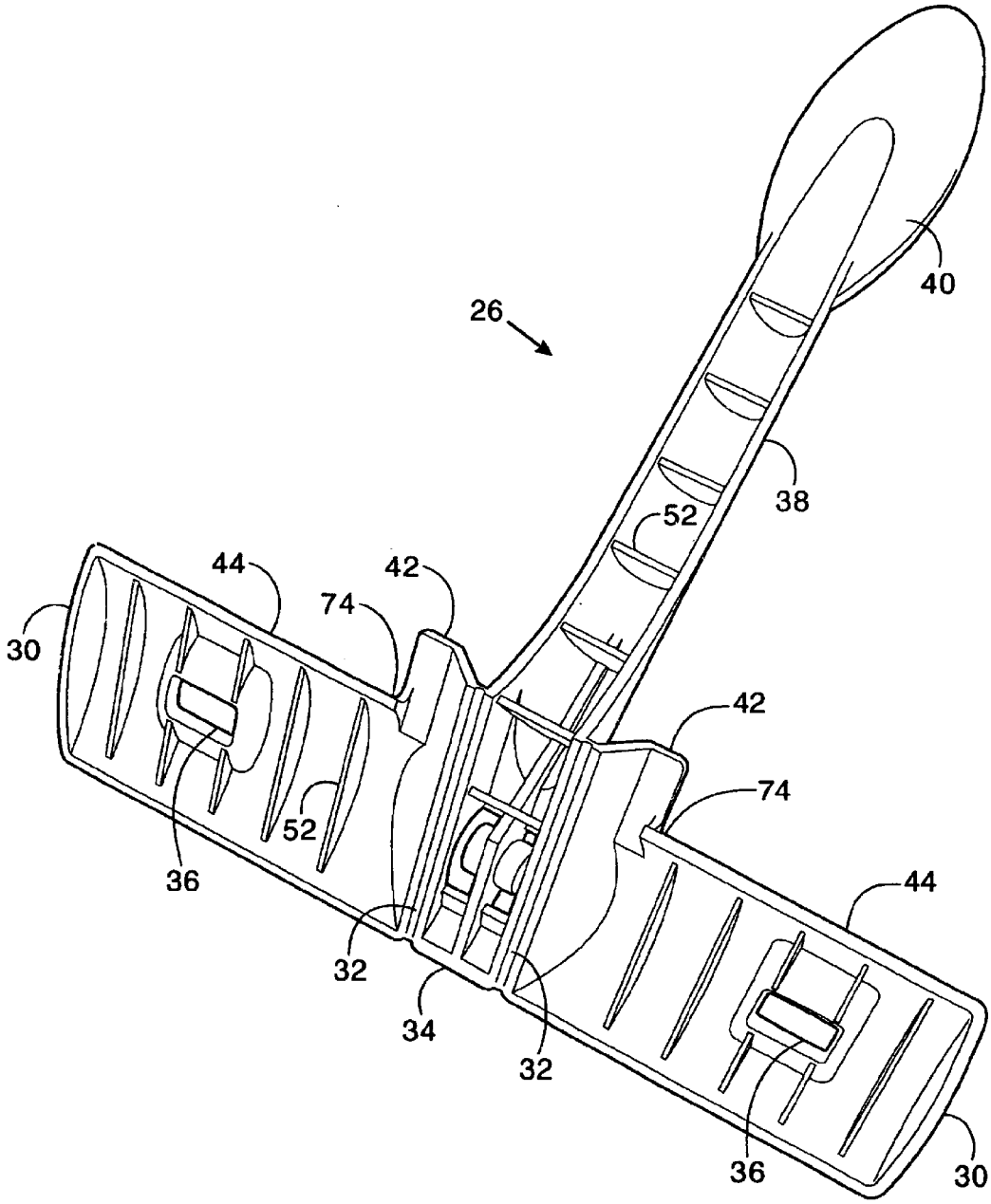
FIG. 7 is a rear perspective view of the actuating lever.

To assemble the wringing assembly 20 during manufacture, the actuating lever 26 is positioned above the enclosed yoke 28 more or less in its fully actuated position as shown in FIG. 3 (e.g., grip 40 forward and wings 30, 30 closed). The bosses 46, 46 on the actuating lever 26 are then pressed downward into their corresponding J-shaped supports 62, 62 on skirt 60. The actuating lever 26 can then be moved back, causing the wings 30, 30 to pass rearward within and through opening 54. Without the detachable sponge 22 attached, wings 30, 30 can easily pass back and forth through opening 54. Preferably the combined thickness of the wings 30, 30 is slightly greater that the corresponding dimension within opening 54, as this prevents the assembly from freely coming apart when the sponge 22 is removed. With the sponge 22 attached, the combined thickness of the wings 30, 30 plus the double thickness of the compressed sponge 22 in its fully actuated position makes it much more difficult or impossible for the wings 30, 30 to fully pass though the opening 54.

In operation, the actual squeezing or compression of the sponge 22 occurs as the user pushes the grip 40 of the actuating lever 26 away from the tubular handle 24, causing the wings 30, 30 to be pulled past guides 66, 66 within the large central opening 54 of the enclosed yoke 28. In its starting position the wings 30, 30 are more or less in line or parallel against rear perimeter edges 72, 72 of the skirt 60, with tabs 42, 42 located within pockets 68, 68. Before the user starts to push the actuating lever 26, guides 66, 66 are located at or near bearing points 74, 74, just outboard of tabs 42, 42 and close to trailing edges 44, 44. During movement of the actuating lever 26 the wings 30, 30 move past the guides 66, 66, causing the paths 76, 76 of the bearing points 74, 74 to move continuously further away from hinges 32, 32, ending up at points 78, 78, more or less centrally located near apertures 36, 36. Tabs 42, 42 have now passed completely through opening 54, but when the user moves the actuating lever 26 back to its starting position, tabs 42, 42 move back into pockets 68, 68, again holding the wings 30, 30 in their original more or less in-line starting position.

By producing a geometry that moves the bearing paths 76, 76 continuously away from the hinges 32, 32 during forward movement of the actuating lever 26, a decreasing movement of wings 30, 30 occurs as lever movement increases, thus producing an increasingly more powerful squeezing action on the sponge 22.

The present invention has now been described in connection with a number of specific embodiments thereof. However, numerous modifications that are contemplated as falling within the scope of the present invention should now be apparent to those skilled in the art.

I claim:

1. A butterfly mop comprising:

an elongated handle;

an enclosed yoke including a pair of girders defining a space therebetween, said yoke further including a skirt integral with said girders, an end of said handle being secured to said yoke opposite said skirt;

a central body and a pair of wings pivotally secured to opposite sides of the central body via hinges, said central body including a manually activated lever extending therefrom;

a sponge detachably secured to an underside of the wings; and wherein the skirt of the yoke is pivotally secured to said central body such that the lever is capable of pivotal movement within the enclosed yoke, wherein the wings are movable from a first mopping position to a second wringing position, said wings and said girders include engagement surfaces which move the wings into the second wringing position upon movement of the lever in a direction away from the yoke and further wherein the wings are returned to the first mopping position when the lever is moved back toward the yoke and which return movement is aided by the compression of the sponge.

2. The mop of claim 1 wherein said yoke is comprised of a single piece of molded plastic.

3. The mop of claim 1 wherein said wings are attached to said central body via living hinges.

4. The mop of claim 1 wherein said central body, said wings, and said lever are comprised of a single piece of molded plastic.

* * * * *